US010368600B2

(12) United States Patent
Goldner

(10) Patent No.: US 10,368,600 B2
(45) Date of Patent: Aug. 6, 2019

(54) HAIRPIECE AND HEADWEAR INCORPORATING THE SAME

(71) Applicant: Vera Goldner, Los Angeles, CA (US)

(72) Inventor: Vera Goldner, Los Angeles, CA (US)

( * ) Notice: Subject to any disclaimer, the term of this patent is extended or adjusted under 35 U.S.C. 154(b) by 225 days.

(21) Appl. No.: 14/910,655

(22) PCT Filed: Aug. 8, 2014

(86) PCT No.: PCT/US2014/050354

§ 371 (c)(1),
(2) Date: Feb. 5, 2016

(87) PCT Pub. No.: WO2015/021389

PCT Pub. Date: Feb. 12, 2015

(65) Prior Publication Data

US 2016/0174645 A1 Jun. 23, 2016

Related U.S. Application Data

(60) Provisional application No. 61/863,777, filed on Aug. 8, 2013.

(51) Int. Cl.

| | |
|---|---|
| ***A41G 3/00*** | (2006.01) |
| ***A41G 5/00*** | (2006.01) |
| ***A42B 1/00*** | (2006.01) |

(52) U.S. Cl.

CPC ..... *A41G 5/0093* (2013.01); *A41G 5/004* (2013.01); *A41G 5/0073* (2013.01); *A42B 1/004* (2013.01)

(58) Field of Classification Search

CPC ..... A41G 5/00; A41G 5/004; A41G 5/0053; A41G 5/0073; A41G 5/0093; A41G 3/0008; A42B 1/004

See application file for complete search history.

(56) References Cited

U.S. PATENT DOCUMENTS

| | | | | |
|---|---|---|---|---|
| 2,781 | A * | 9/1842 | Deville | A41G 3/0041 132/54 |
| 3,636,962 | A | 1/1972 | Frackowiak | |
| 3,782,396 | A | 1/1974 | Tomlinson | |
| 3,910,292 | A | 10/1975 | Izzo | |
| 4,492,242 | A | 1/1985 | Dalton | |
| 4,804,003 | A | 2/1989 | Moen | |

(Continued)

FOREIGN PATENT DOCUMENTS

WO 2015021389 A3 2/2015

OTHER PUBLICATIONS

PCT/US2014/050354 Response to Written Opinion Under Article 34 dated Jul. 22, 2015.

(Continued)

*Primary Examiner* — Rachel R Steitz
(74) *Attorney, Agent, or Firm* — Polsinelli PC

(57) ABSTRACT

Disclosed is a an attachable hairpiece and headwear adapted to use the attachable hairpiece where the attachable hairpiece includes a plurality of hairs having a first end and a second end, a binding for the plurality of hairs disposed at the first end of the plurality of hairs, where the binding has a width of from about 2.5 inches to about 18 inches, and a fastener secured to the first end of the plurality of hairs, where the fastener has a width of from about 2.5 inches to about 18 inches.

18 Claims, 16 Drawing Sheets

(56) References Cited

U.S. PATENT DOCUMENTS

| | | | | |
|---|---|---|---|---|
| 4,949,737 | A * | 8/1990 | Nakamura | A41G 3/0041 132/53 |
| 5,170,509 | A | 12/1992 | Leopold | |
| 5,239,705 | A | 8/1993 | Leopold | |
| 5,493,735 | A * | 2/1996 | Rice | A41G 5/0093 2/174 |
| 5,647,384 | A | 7/1997 | Haber et al. | |
| 5,819,319 | A | 10/1998 | Spurs | |
| 7,047,571 | B1 | 5/2006 | Kelly | |
| D599,532 | S | 9/2009 | Sheng | |
| 2003/0029467 | A1 | 2/2003 | Katon | |
| 2006/0191057 | A1 | 8/2006 | Lynn | |
| 2007/0283975 | A1 | 12/2007 | Ma | |
| 2009/0188512 | A1* | 7/2009 | Eaton | A41G 5/0073 132/54 |
| 2011/0055996 | A1 | 3/2011 | Pomell | |
| 2011/0186066 | A1* | 8/2011 | Twersky | A41G 3/00 132/54 |

OTHER PUBLICATIONS

Hat & Hair, Copyright© 2009, http://www.hatandhair.com/hats_fabric.html.

Hats For You, Copyright© 2003-2012, http://www.hatsforyou.net/servlet/the-Baseball-Cap-with-Hair/Categories.

Headcovers Unlimited, Inc., © 1994-2012, http://www.headcovers.com/292/detachable-hair/.

International Search Report dated Apr. 22, 2015 regarding PCT/US2014/050354.

Int'l Preliminary Report on Patentability and Written Opinion dated Apr. 22, 2015 regarding PCT/US2014/050354.

International Preliminary Examination Report dated Nov. 23, 2015 regarding PCT/US2014050354.

* cited by examiner

HAIRPIECE AND HEADWEAR INCORPORATING THE SAME

CROSS-REFERENCE TO RELATED APPLICATION

This application is a 371 National Stage Entry of PCT application PCT/US2014/050354 entitled "HAIRPIECE AND HEADWEAR INCORPORATING THE SAME," filed Aug. 8, 2014 which claims the benefit of U.S. Provisional Patent Application No. 61/863,777, entitled REATTACHABLE HAIRPIECES AND HEADWEAR INCORPORATING THE SAME, and filed on Aug. 8, 2013, both of which are hereby expressly incorporated by reference herein in their entireties.

BACKGROUND

1. Field

The present invention relates to articles of manufacture. More particularly, the present invention relates to hairpieces and headwear incorporating the hairpieces.

2. Background

It is often desirable for women with short or unkempt hair to wear fashionable headwear to cover their heads. In addition, women may want to wear fashionable headwear that covers their hair for religious reasons or that covers their heads because they have lost their hair. Different headwear can be worn depending on the mood of the wearer or the occasion.

To heighten the fashionable effect, it may be desirable to attach a stylish hairpiece to the fashionable headwear. Accordingly, there is a desideratum for stylish hairpieces that are attachable to headwear. There is a further desideratum for attachable hairpieces that are reattachable and interchangeable with a variety of different headwear to be worn depending on the mood of the wearer or the occasion. There is a still further desideratum for a hairpiece that can be worn in a number of different styles with the headwear depending on the mood of the wearer or the occasion.

SUMMARY OF THE INVENTION

Now there has been discovered an attachable hairpiece and headwear adapted to use the attachable hairpiece that provide these and further related advantages. In one aspect of the invention, an attachable hairpiece comprises a plurality of hairs having a first end and a second end, a binding for the plurality of hairs disposed at the first end of the plurality of hairs, where the binding has a width of from about 2.5 inches to about 18 inches, a fastener secured to the first end of the plurality of hairs, where the fastener has a width of from about 2.5 inches to about 18 inches.

In some embodiments, the binding has a width from about 3½ inches to about 16 inches; in some embodiments, the binding has a width from about 4½ inches 9 inches; in some embodiments, the binding has a width from about 15 inches to about 17 inches and in some embodiments, the binding has a width of from about 2½ inches to about 3½ inches. In some embodiments, the binding has a height of from about 1½ inches to about 2½ inches and in some embodiments, the binding has a height of from about 1¾ inch to about 2¼ inch.

In an aspect of the invention, the fastener is a flexible hook and loop fastener. In some embodiments, the fastener has a width from about 3½ inches to about 16 inches, in some embodiments, where the fastener has a width from about 4½ inches 9 inches; in some embodiments, the fastener has a width from about 15 inches to about 17 inches; and in some embodiments, the fastener has a width of from about 2½ inches to about 3½ inches. In some embodiments, the fastener has a height of from about ½ inch to about 1 inch and in some embodiments, the fastener has a height of from about ⅝ inch to about ⅞ inch.

In another aspect of the invention, the plurality of hairs are natural hair or synthetic hair and, in an aspect of the invention, the plurality of hairs are kosher.

In some embodiments, the plurality of hairs have a length greater than about 10 inches and, in some embodiments, the plurality of hairs have a length between about 12 inches and about 16 inches. In some embodiments, the plurality of hairs has a length to width ratio of from 5.5:1 to about 2:1, in some embodiments, the plurality of hairs have a length to width ratio of from about 4.5:1 to about 2:1; in some embodiments, the plurality of hairs have a length to width ratio of from about 3.5:1 to about 2.5:1; and in some embodiments, the plurality of hairs have a length to width ratio of from about 1:1.33 to about 1:1. In some embodiments, the plurality of hairs have a weight of from about 50 grams to about 200 grams; in some embodiments, the plurality of hairs have a weight of from about 50 grams to about 125 grams: in some embodiments, and in some embodiments, the plurality of hairs have a weight of from about 125 grams to about 200 grams.

In an aspect of the invention, the headwear incorporating an attachable hairpiece comprises headwear having an interior surface, a complementary fastener affixed to the interior surface and an attachable hairpiece where fastener is secured to the complementary fastener. And in an aspect of the invention, the complementary fastener is a flexible hook and loop fastener.

In some embodiments, the complementary fastener has a width from about 3.5 inches to about 16 inches; in some embodiments, the complementary fastener has a width from about 4.5 inches to about 9 inches; in some embodiments, the complementary fastener has a width from about 15 inches to about 17 inches; and in some embodiments, the complementary fastener has a width of from about 2.5 inches to about 3.5 inches. In some embodiments, the fastener has a height of from about ½ inch to about 1 inch hairs and in some embodiments, the fastener has a height of from about ⅝ inch to about ⅞ inch.

BRIEF DESCRIPTION OF THE DRAWINGS

The accompanying drawings, together with the specification, illustrate exemplary embodiments, and, together with the description, serve to explain the principles of these embodiments.

DETAILED DESCRIPTION OF THE PREFERRED EMBODIMENTS

Particular embodiments of the invention are described below in detail for the purpose of illustrating its principles and operation. However, various modifications may be made and the scope of the invention is not limited to the exemplary embodiments described below.

Figure 1:
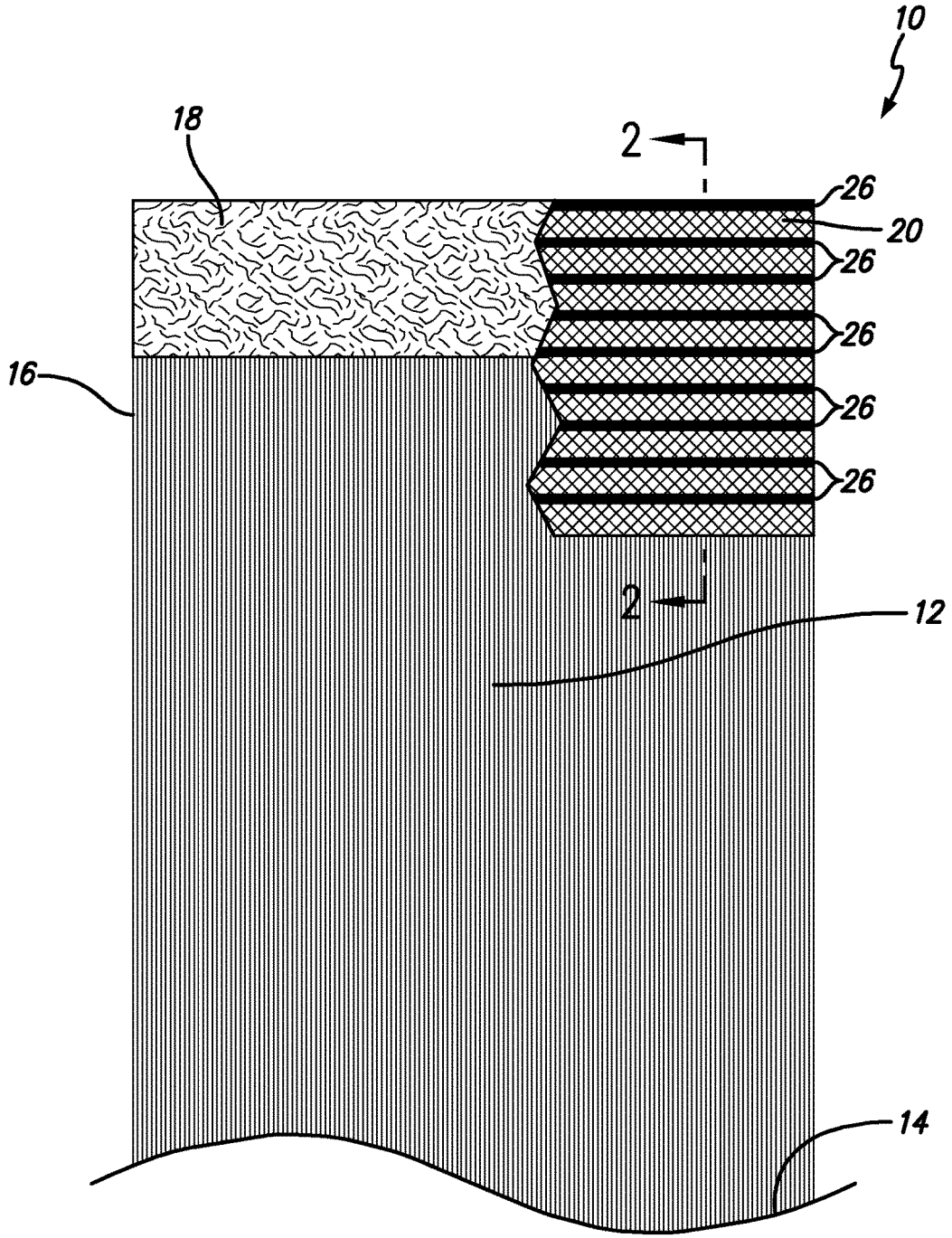
FIG. 1 is a partially cutaway front elevation view illustrating one aspect of a reattachable hairpiece in accordance with one aspect of the invention.
Figure 2:
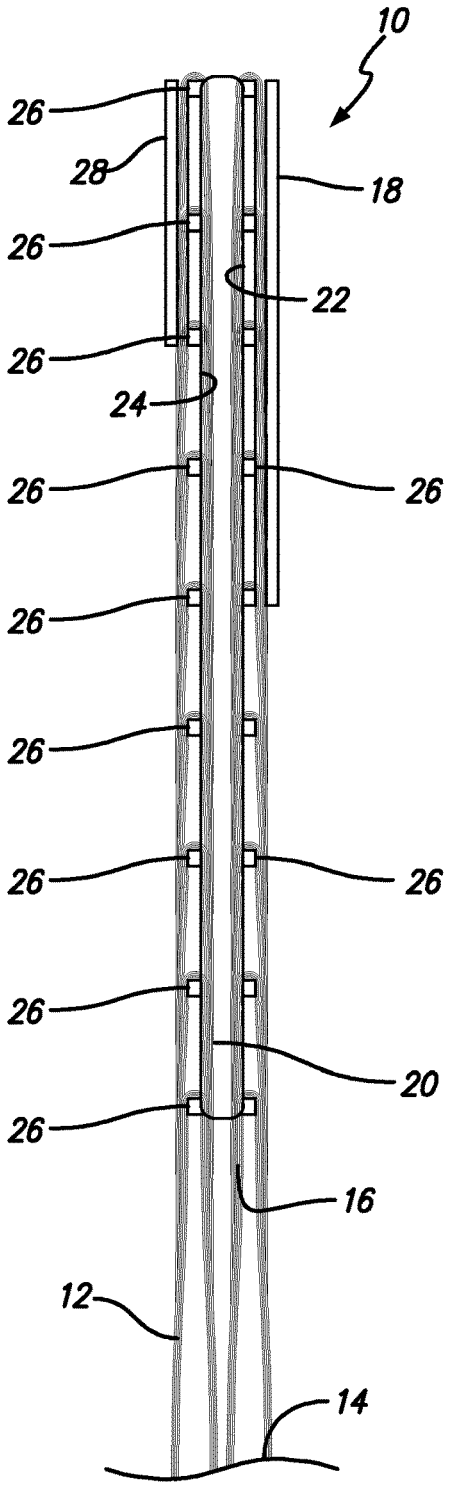
FIG. 2 is a cutaway partial side elevation view cutaway of the reattachable hairpiece of FIG. 1.

FIG. 1 is a partially cutaway front elevation view of a reattachable hairpiece in accordance with one aspect of the invention and FIG. 2 is a cutaway partial side elevation view of the reattachable hairpiece. In one aspect, there has been discovered a reattachable hairpiece 10 comprising a plurality of hairs 12. The plurality of hairs has a free end and 14 and an attached end 16.

In some aspects, the plurality of hairs 12 are bound to one another at the attached end 16. The plurality of hairs can be bound by any suitable means. In the representative embodiment shown in FIGS. 1 and 2, the binding comprises a base 20 having opposing front 22 and rear 24 surfaces. In some embodiments, the base has a generally rectangular shape. And in some embodiments, the base has a width of from about 2½ inches to about 18 inches, in some embodiments from about 3½ inches to about 16 inches and in some embodiments from about 4½ inches to about 9 inches. In some embodiments, the base has a height of from about 1½ inches to about 2½ inches and, in some embodiments, the base has a height of from about 1¾ inch to about 2¼ inch.

In some embodiments, the base 20 is formed of a flexible mesh or net material. And in some embodiments, extending longitudinally across at least one the surfaces of the base 20 is at least one strip of bias tape 26, each strip securing a portion of the plurality of hairs to the base. In the representative embodiment shown in FIG. 2, nine opposing pairs of bias tape strips, evenly spaced on both sides 22 and 24 of the base, secure the plurality of hairs to the base. In some embodiments, sections of real or artificial hair 12 are secured to the surface of the bias tape 26 and the bias tape sewn on to the surfaces 22 and 24 of the base 20.

In one aspect, the top of back surface 24 of the base 20 is finished with a strip of material 28, such as a plastic or cloth material, including without limitation, a strip of the same type of mesh or net material used for the base or a soft, felt-like material. In some embodiments, the finishing strip has the same width as the base. In some embodiments, the finishing strip has a height of from about ¼ inch to about ¾ inch and, in some embodiments, a height of from about ⅜ inch to about ⅝ inch.

In one aspect of the invention, a fastener 18 for attaching the plurality of hairs 12 to a headwear is secured to the attached end 14 of the plurality of hairs 12. The fastener can be directly or indirectly secured to the plurality of hairs by any suitable means, such as with an adhesive.

Any suitable fastener can be employed. In one aspect, the fastener is part of a flexible hook and loop fastener, such as a VELCRO® hook and loop fastener. In a presently preferred embodiment, the fastener is the hook fastener affixed to the plurality of hairs 12 on the front surface 22 of the base 20. In some embodiments, the fastener 18 has the same width as the base 20. In some embodiments, the hook and loop fastener has a height of from about ½ inch to about 1 inch and, in some embodiments, a height of from about ⅝ inch to about ⅞ inch.

Figure 3:
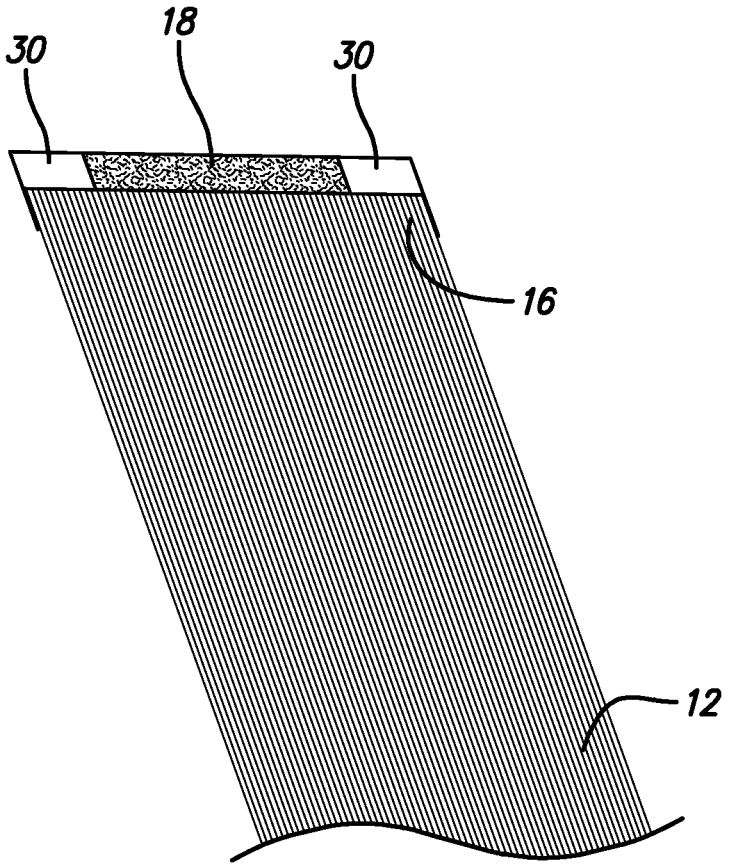
FIG. 3 is front elevation view of an embodiment of the reattachable hairpiece of FIG. 1.

In alternative embodiments, one or more fasteners 18, each having a width smaller than the width of the base 20, are employed. For example, in the representative embodiment shown in FIG. 3, a finishing material 30, such as a plastic or cloth finishing material is secured to the bound ends of the hair 16 at the top of the base 20, using any suitable method, such as stitching. The one or more fasteners are then affixed to the finishing material using any suitable method, such as with an adhesive. In one aspect, the one or more fasteners have a length of from about 3 inches to about 4 inches.

In another aspect, a finishing material, such as a plastic or cloth finishing material is secured to the bound ends of the hair at the top of the base, using any suitable method, such as stitching. One or more magnets are then affixed to the finishing material using any suitable method, such as with an adhesive, and one or more magnets having an opposite polarity are placed on the inside of the headpiece so that they are aligned with the magnets on the hair piece when the hairpiece is attached to the headwear.

The hair can be of any suitable material. In some embodiments, the plurality of hairs is natural hair. And in some embodiments, the plurality of hairs is kosher. In some embodiments, the plurality of hairs is synthetic and in some embodiments is made of a material that gives the appearance that it is the user's hair.

Figure 4:
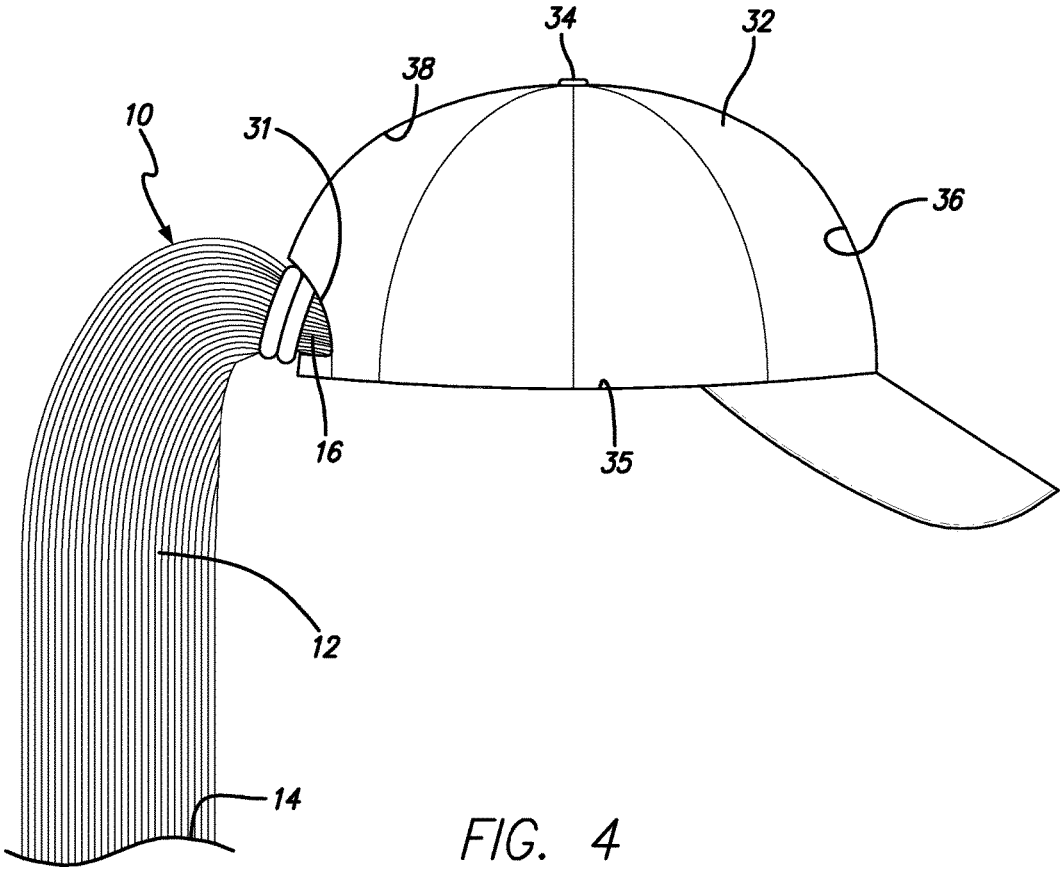
FIG. 4 is a side elevation view illustrating one embodiment of headwear with a reattachable hairpiece in accordance with the invention.
Figure 5:
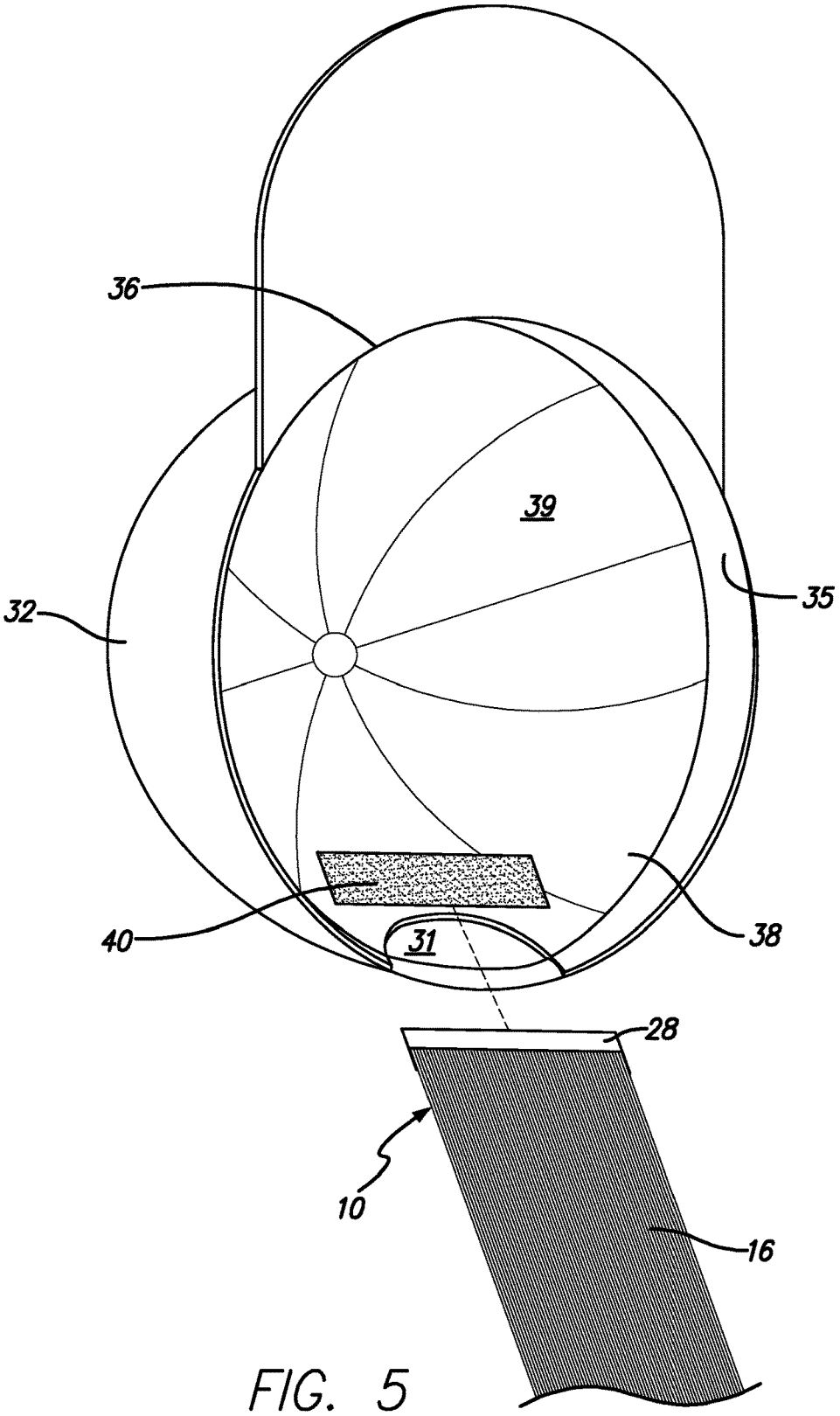
FIG. 5 is a bottom elevation view of the headwear and reattachable hairpiece of FIG. 3 with the reattachable hairpiece detached from the headwear.
Figure 6A:
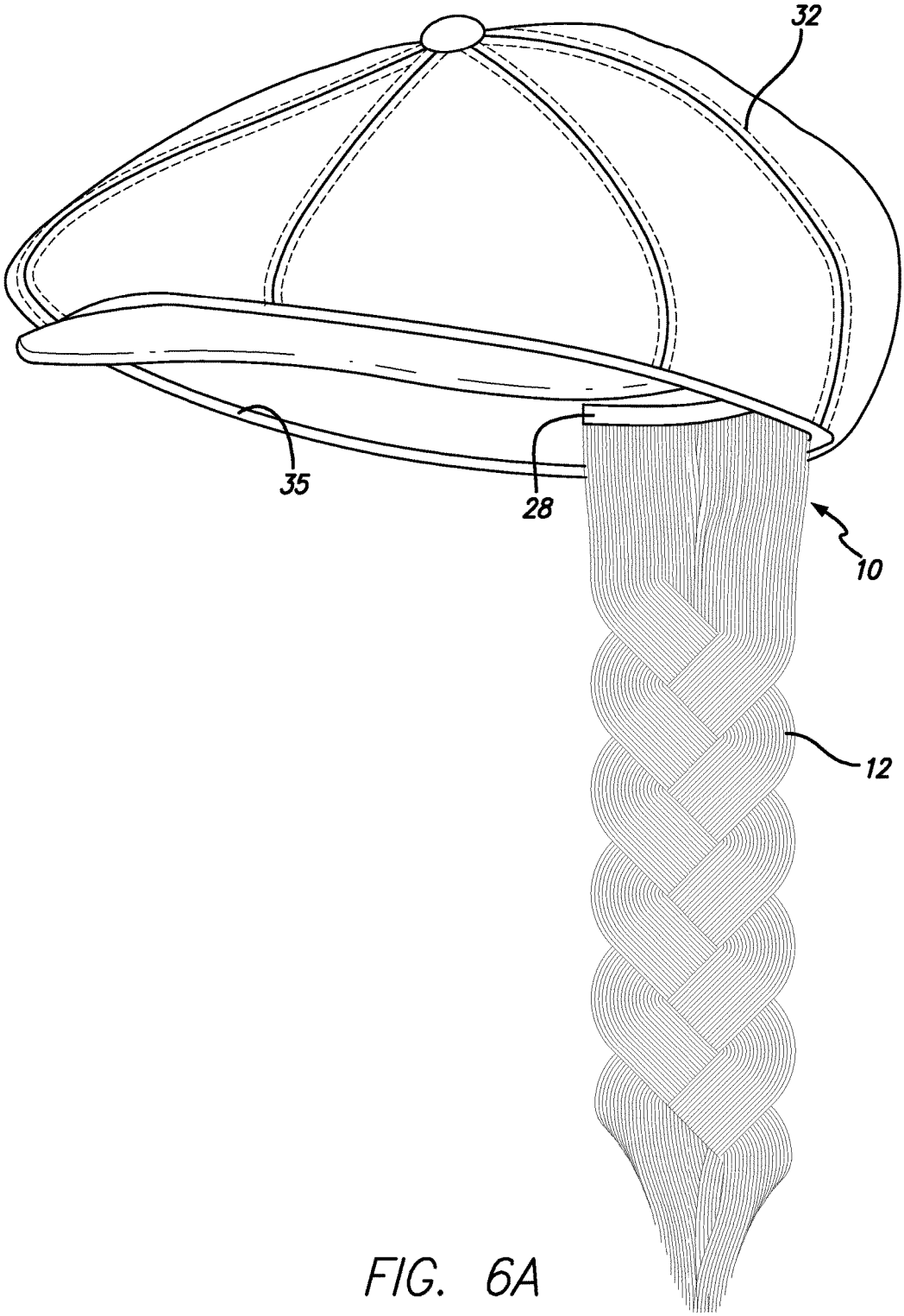
FIGS. 6A-C are elevation views illustrating additional embodiments of headwear with the reattachable hairpiece.
Figure 6B:
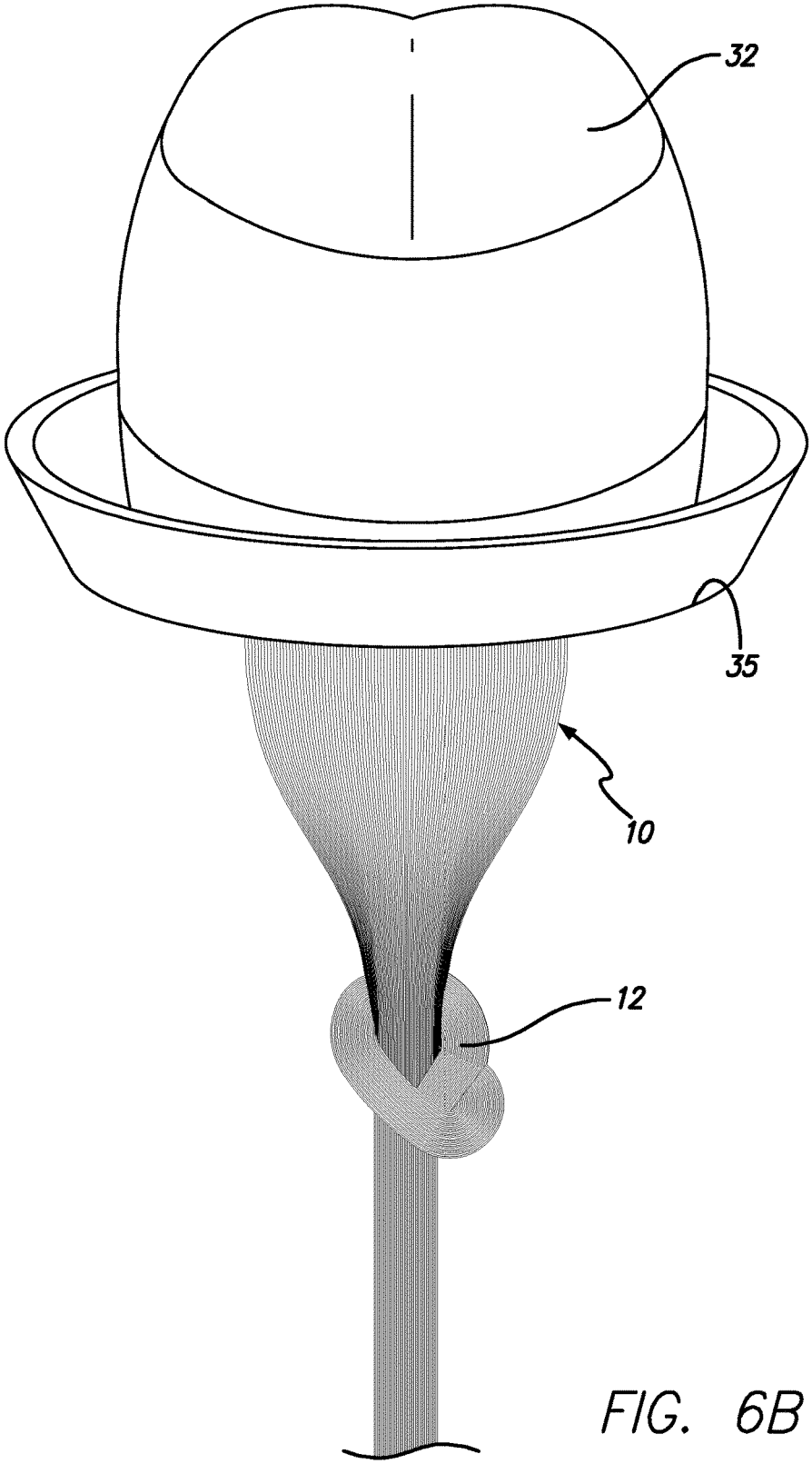
Figure 6C:
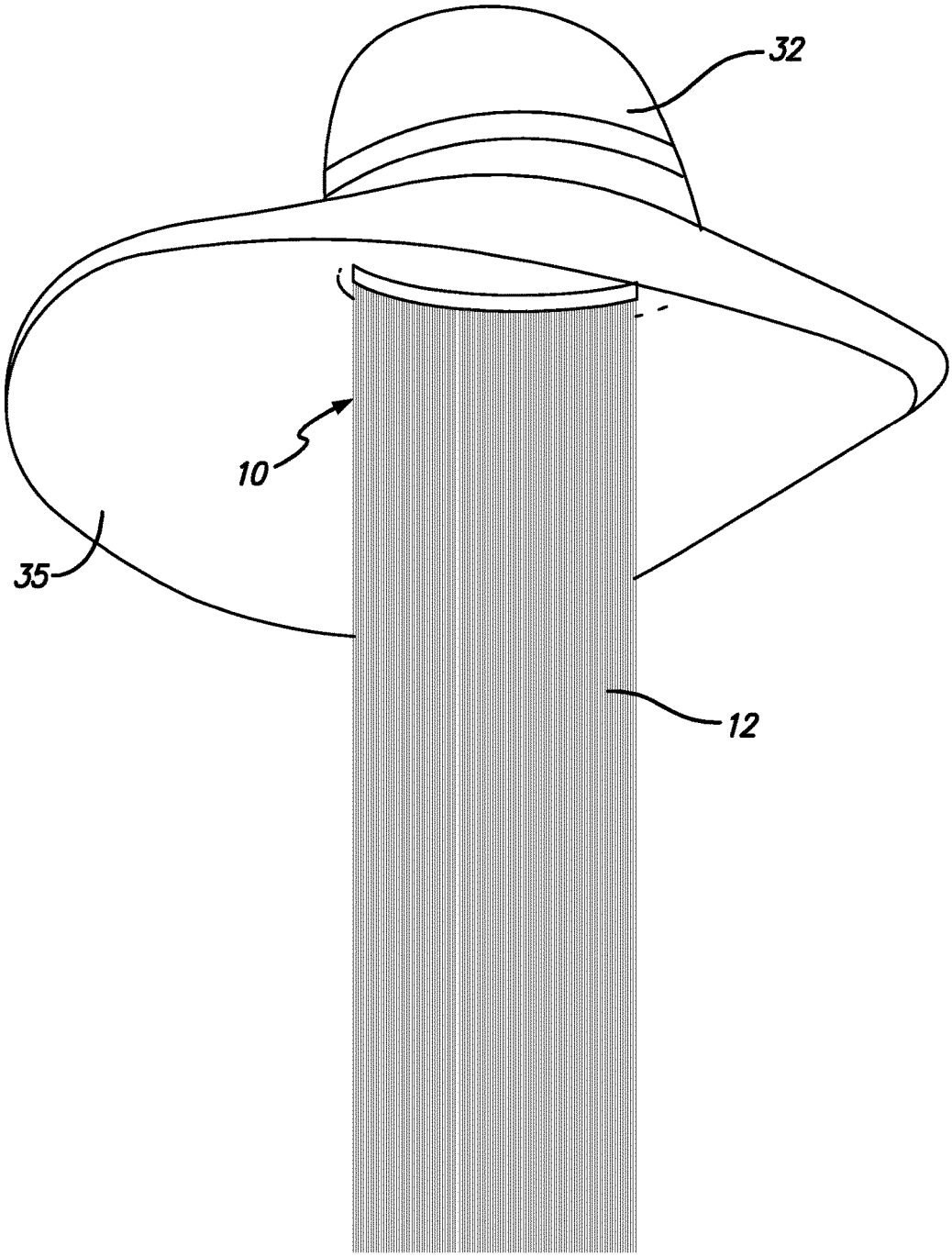

In one aspect, as shown in FIGS. 4 and 5, the hairpiece 10 is designed to fit through the opening 31 of headwear, such as a cap 32. In another aspect, as shown in FIGS. 6A-6C, the hairpiece 10 is designed to extend below the bottom 35 of the headwear 32.

In exemplary embodiments, where the hairpiece 10 is designed to fit through the opening 31 of the headwear, the base 20 of the hairpiece has a width of from about 2½ inches to about 3½ inches and, in some embodiments, the base has a width of from about 2¾ inch to about 3¼ inch. In exemplary embodiments, where the hairpiece is designed to extend below the bottom 35 of the headwear, the base of the hairpiece has a width of from about 12 inches to about 17 inches and, in some embodiments, the base has a width of from about 14 inches to about 16 inches.

In some aspects, the plurality of hairs 12 has a length greater than about 10 inches and, in some aspects, a length between about 12 inches and about 16 inches. In some aspects, the plurality of hairs has a length to width ratio of from 5.5:1 to about 2:1. In some embodiments, where the hairpiece 10 is designed to fit through the opening 31 of headwear, such as a cap 32, the plurality of hairs has a length to width ratio of from about 4.5:1 to about 2:1 and, in some embodiments, a length to width ratio of from about 1 3.5:1 to about 2.5:1. In some embodiments, where the plurality of hairs is designed extend below the bottom of the hairpiece, the plurality of hairs has a length to width ratio of from about 1:1.33 to about 1:1.

In some aspects, the reattachable hairpiece has a weight of from about 50 grams to about 200 grams. In some embodiments, where the hair piece 10 is designed to fit through the opening 38 of a cap 32, the reattachable hairpiece has a weight of from about 50 grams to about 125 grams and in some embodiments, the reattachable hairpiece has a weight of from about 70 grams to about 100 grams. In some embodiments, where the hair piece 10 is designed to extend below the bottom 35 of a cap 32, the plurality of hairs has a weight of from about 125 grams to about 200 grams and in some embodiments from about 150 about 175 grams.

It is a distinct advantage of the invention, that the reattachable hairpiece can be worn in a wide variety of styles. Representative styles include, without limitation, in a pony tail (FIGS. 4 and 5), braided (FIG. 6A), knotted, (FIG. 6B) and straight (FIG. 6C).

In the representative embodiment shown in FIGS. 4 and 5, the headwear is a baseball cap 32 having a top 34, a bottom 35, a front 36 and a back 38 defining an interior surface 39 (FIG. 5). As best seen in FIG. 4, in some aspects, the cap also contains an opening 31 in the back of the cap. And as seen in FIG. 5, a complementary hook and loop fastener 40 is positioned above the opening 31. In the embodiment shown in FIG. 4, the complementary hook and loop fastener has dimensions that are substantially the same as the hook and loop fastener 18. The reattachable hairpiece 10 is attached to the hat by passing the hook and loop fastener through the opening and securing the fastener to the complementary hook and loop fastener in the back of the cap.

It is another distinct advantage of the invention, that a single reattachable and interchangeable hairpiece 10 can be used with a wide variety of hats by placing complimentary fasteners in more than one style of hat. In addition to the baseball caps, representative hats include newsboy caps (FIG. 6A), fedoras (FIG. 6B), wide brim sunhats (FIG. 6C) and the like.

Figure 7:
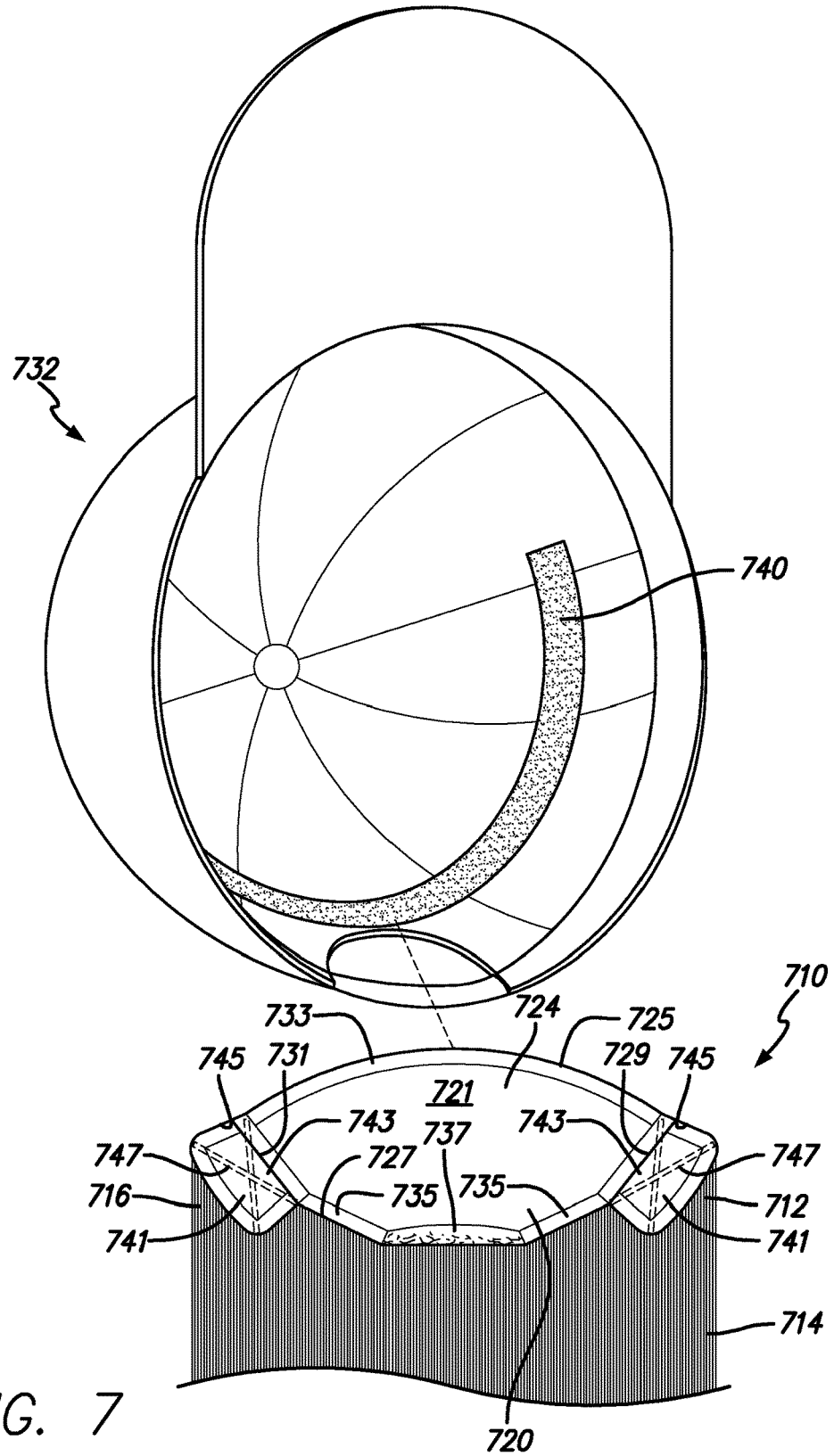
FIG. 7 is a bottom elevation view illustrating another aspect of a reattachable hairpiece in accordance with one aspect of the invention.

FIG. 7 is a partially cutaway front elevation view of a reattachable hairpiece 710 in accordance with another aspect of the invention. This embodiment shares many of the features of construction as the hairpiece shown in FIGS. 1 and 2 including a plurality of hairs 712 having a free end and 714 and an attached end 716.

In one aspect of a hairpiece in accordance with the invention a plurality of hairs 712 are bound to one another at the attached end 716. The plurality of hairs can be bound by any suitable method. In the representative embodiment shown in FIG. 7, the binding comprises a body portion 721 having a front surface (not shown), an opposing rear surface 724 and a top, having a top edge 725, a bottom, having a bottom edge 727, and opposing sides, having side edges 729 and 731. In one aspect, the top edge is substantially straight and, in some embodiments, the top has a width of from about 10 inches to about 15 inches and, in some embodiments, the top has a width of from about 12 inches to about 17 inches.

In one aspect, the top, the bottom, and opposing the sides, define a concave surface that conforms to the user's head when the hairpiece 710 is attached to headwear, such as cap 732. In some embodiments, the perimeter formed by the top edge 725, the bottom edge 727, and the side edges 729 and 731 is finished with a thin strip of finishing material 733, such a cloth material, and, in some embodiments, at least a portion of the sides and/or bottom of the perimeter is finished with an elastic finishing material, such that the perimeter contains at least one stretchable portion 735. In some embodiments, a contact portion 737, such as a contact portion made of a soft material, including without limitation a felt-like material, is fastened to the center of the bottom edge of the body. The representative embodiment shown in FIG. 7 includes two stretchable portions and a contact portion. The at least one stretchable portion aids in conforming the body to the user's head, while the contact portion provides some protection where the bottom of the hairpiece contacts the user's neck. In some embodiments, the length of the perimeter portion formed by the bottom and the opposing sides is from about 14 inches to about 20 inches and, in some embodiments, the length of the perimeter portion formed is from about 16 inches to about 18 inches.

Extending axially from the opposing sides 729 and 731 of the body 721 are a pair of ear portions 741 having a front surface (not shown) and a rear surface 743. In some embodiments, the front surface is integral with the front surface of the base and, in some embodiments, the rear surface is formed from a soft material, including without limitation a felt-like material. The ear portions can have any suitable shape. In the representative embodiment shown in FIG. 7, the ear portions have a generally rectangular shape with a width of from about ¾ inch to 1¾ inch and a height of from about 1 inch to about 3 inches. In one aspect, the top of each ear portion 745 together with the top of the body portion 725 form an attachment edge and are finished with the same piece of material 733. In some embodiments, the attachment edge is substantially straight and, in some embodiments, the attachment edge has a width of from about 12 inches to about 17 inches and, in some embodiments, the base has a width of from about 14 inches to about 16 inches.

In one aspect, one or more stays are interposed between the front surface and the rear surface 743 of each ear portion 741. The stays can be made of any suitable material, such as a metal or plastic material. In the representative embodiment shown in FIG. 7, each stay 747 is formed of a pair of plastic-coated metal wires extending between the diagonally opposing corners of the rectangular ear portions.

In one aspect, a fastener for attaching the plurality of hairs 712 to a headwear 732 is secured to the attached end plurality of hairs 716 secured to the front surface of the base. The fastener can be directly or indirectly secured to the plurality of hairs by any suitable means, such as with an adhesive.

Figure 8:
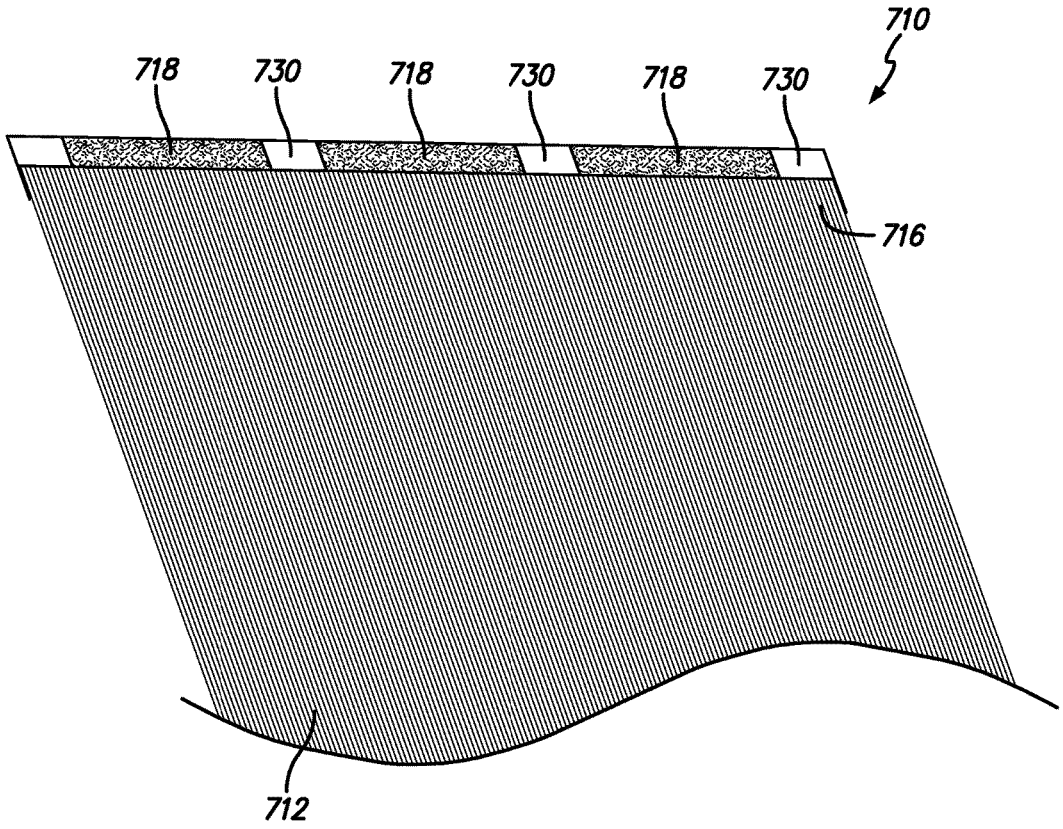
FIG. 8 is back elevation view of an embodiment of the reattachable hairpiece of FIG. 1.

The hairpiece 710 can be attached to the headwear 732 by any suitable means, including permanently attached to the headwear. In one aspect, a reattachable suitable fastener is employed. In a preferred embodiment shown in FIG. 8, the reattachable fastener is part of a flexible hook and loop fastener, such as a VELCRO® hook and loop fastener 718 and 740. In a presently preferred embodiment, the fastener is the hook fastener secured to the attached end 716 of the plurality of hairs 712. In some embodiments, the hook and loop fastener has a height of from about ½ inch to about 1 inch and, in some embodiments, a height f from about ⅝ inch to about ⅞ inch. In some embodiments, the hairpiece includes a single fastener having a width substantially the same as the width of the attachment edge.

In alternative embodiments, a plurality of loop fasteners 718, each having a width smaller than the width than the width of the base are used. For example, in the representative embodiment shown in FIG. 8, the a finishing material 730, such as a plastic or cloth finishing material, is secured to the bound ends of the hair 716 at the top of the base, using any suitable method, such as stitching. Three loop fasteners are then affixed to the finishing material using any suitable method, such as with an adhesive. In one aspect, the one or more loop fasteners have a width of from about 3 inches to about 4 inches and are spaced apart from one another by about ½ inch to about 1½ inch.

In a related aspect, in some embodiments, a plurality of complementary hook fasteners is placed on the inside of the cap, so that each loop fastener contacts a hook fastener when the hairpiece is attached to the cap. In some embodiments, each hook fastener has a width of from about ½ inch to about 1½ inch and a height of from about 1½ inch to about 2½ inches.

Figure 9:
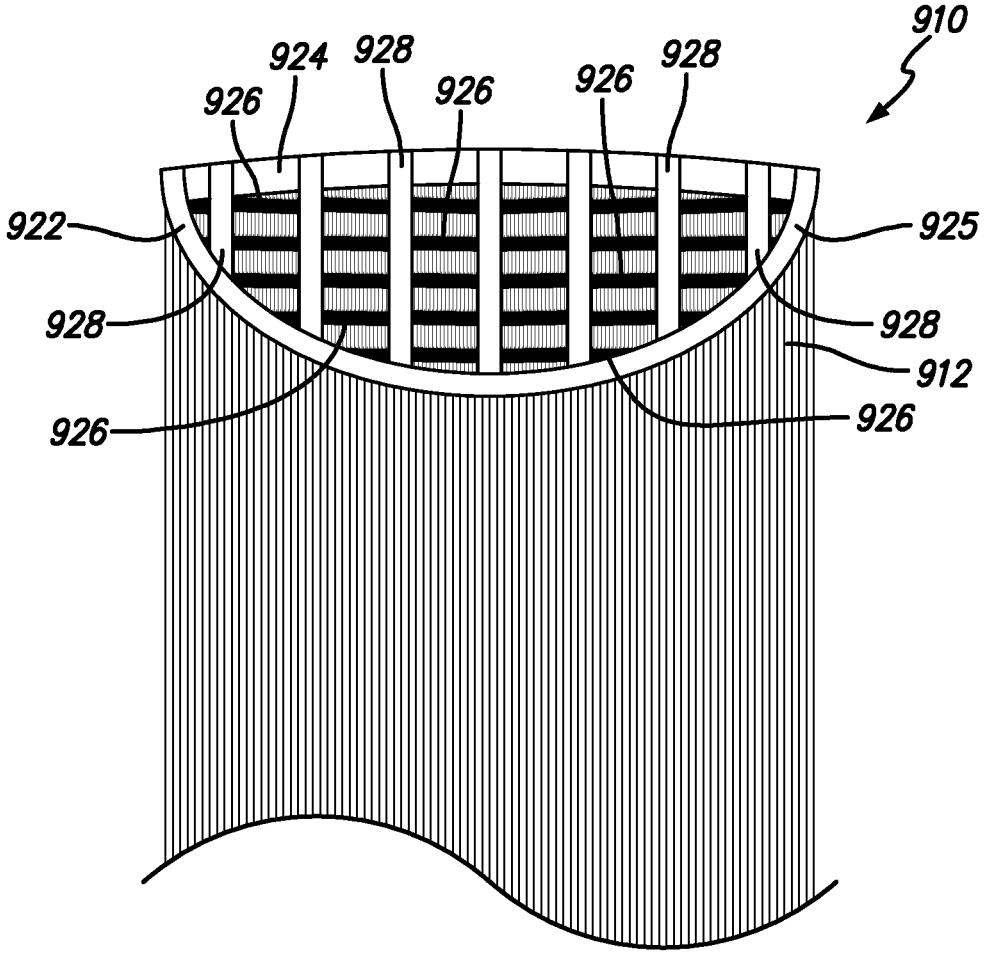
FIG. 9 is rear elevation view illustrating another aspect of a reattachable hairpiece in accordance with one aspect of the invention.

Shown in FIG. 9 is another aspect of for the construction of or a hairpiece 910. In the representative embodiment shown in FIG. 9, the base is formed of a shell 922 having a top defined by a substantially linear first piece 924 and a generally curved side and bottom comprised of one or more second pieces 925. A plurality of linear rib pieces 928 extend linearly from the first piece and are attached to the second piece. In some embodiments, the first piece has a width of from about 12 inches to about 17 inches and, in some embodiments, the first piece has a width of from about 14 inches to about 16 inches. In some embodiments, the length of the curved sides and bottom is from about 14 inches to about 20 inches and, in some embodiments, the length of the curved sides bottom is from about 16 inches to about 18 inches.

The first piece 924, the second piece 925 and the rib pieces 928 can be made of any suitable material, such as cloth finishing material and may be made of the same or different material. Together the first piece, the second piece and the ribs form a concave surface that conforms to the user's head when the hairpiece 910 is attached to headwear. The hairpiece 912 can be attached to headwear by any suitable method, such as by a VELCRO® hook and loop fastener or by magnets.

In another aspect, a finishing material, such as a plastic or cloth finishing material is secured to the bound ends of the hair at the top of the base, using any suitable method, such as stitching. One or more magnets are then affixed to the finishing material using any suitable method, such as with an adhesive, and one or more magnets having an opposite polarity are placed on the inside of the headpiece so that they are aligned with the magnets on the hair piece when the hairpiece is attached to the headwear.

And in one aspect, extending longitudinally the shell 922 is at least one strip of bias tape 926, each strip securing a portion of the plurality of hairs 912 to the shell. In the representative embodiment shown in FIG. 9, six evenly spaced strips of bias tape are shown securing the plurality of hairs to the shell. In some embodiments, sections of real or artificial hair 912 are secured to the surface of the bias tape 926 and the bias tape sewn on to the shell.

Figure 10:
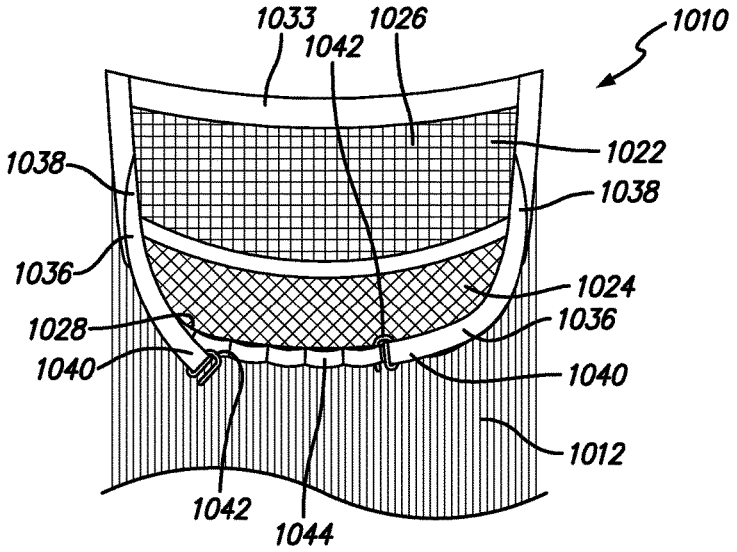
FIG. 10 is back elevation view of an embodiment of a reattachable hairpiece illustrating another aspect of the invention.
Figure 11:
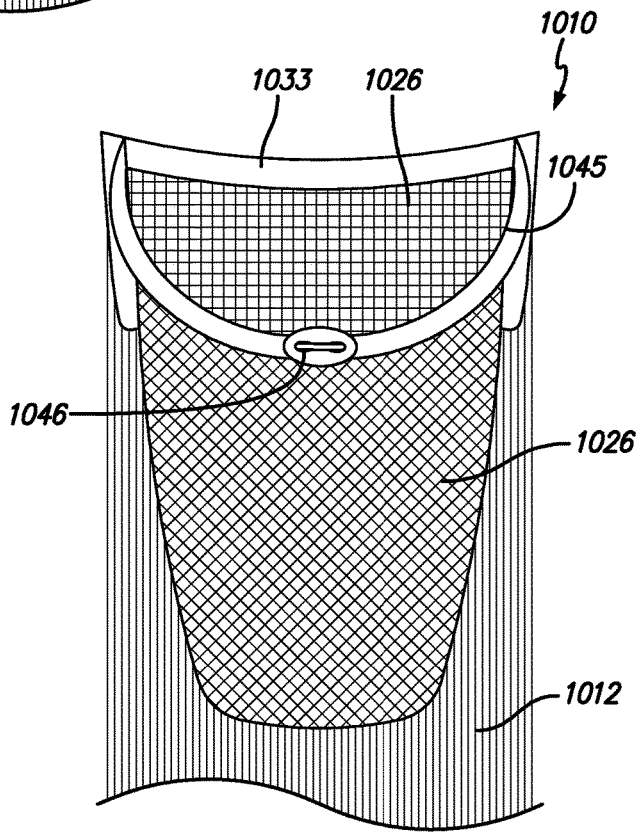
FIG. 11 is back elevation view of an embodiment of a reattachable hairpiece illustrating another aspect of the invention.
Figure 12A:
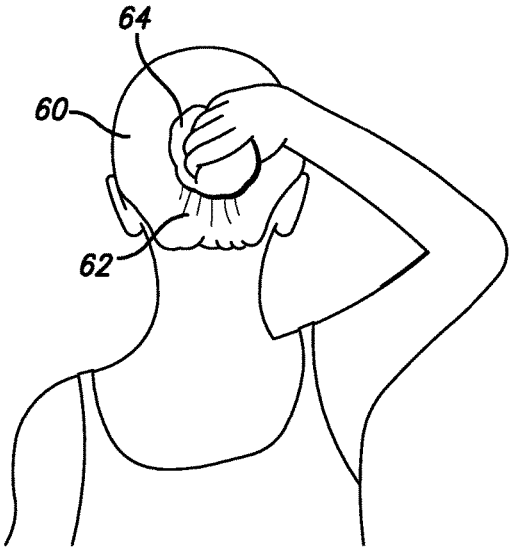
FIGS. 12A-D illustrate a method for securing the headwear, including the hairpiece of FIG. 4 to the head of a user.
Figure 12B:
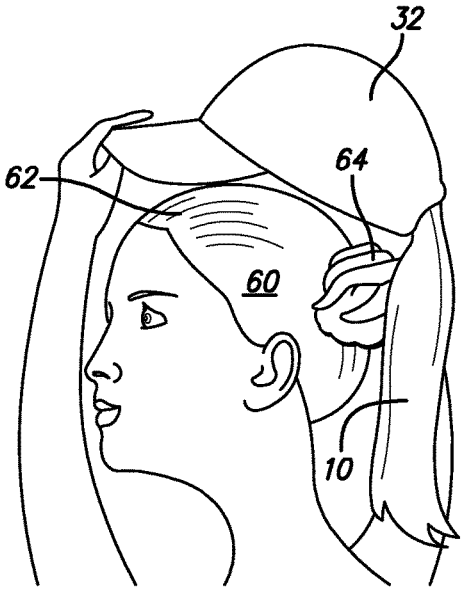
Figure 12C:
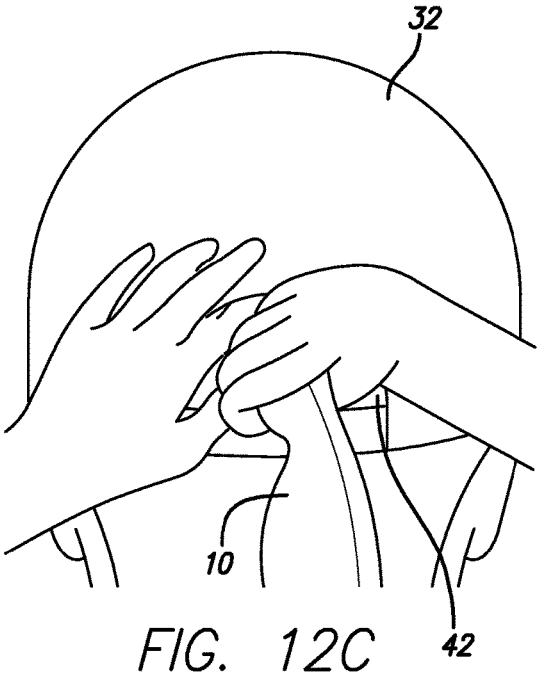
Figure 12D:
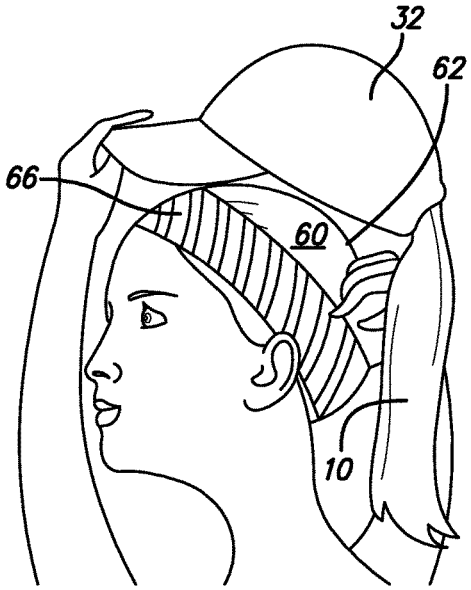

As shown in FIGS. 10 and 11, in one aspect, a hairpiece 1010 includes a pocket 1022 for holding the user's hair 1012. The pocket has a front 1024, a back 1026, a pair of opposing sides 1028 and 1030, a bottom 1032 and an open top 1034. The dimensions of the pocket can be chosen to accommodate the style of a user's natural hair. For, example, in the representative embodiment illustrated in FIG. 10, a pocket having a relative short length and a rounded bottom is designed for use with a bun, as shown in FIGS. 6A-6D. In the representative embodiment shown FIG. 11, the pocket has a longer length and is designed for use with user's hair that is not contained in a bun. In some embodiments, the pocket has a width of from about 1½ inches to about 6 inches and, in some embodiments, the base has a width of from about 2½ inches to about 3½ inches. And in some embodiments, the pocket has a height of from about 2 inches to about 6 inches.

The pocket 1022 can be made of any suitable material. In some embodiments, the material is a netting material and in some embodiments, the material has elastic properties. In some embodiments, the pocket is made of a single piece and, in some embodiments, the front and back are made of two pieces or more pieces, which may be made of the same or different material. In those embodiments where the front and back are made of separate pieces of material, the pieces can be attached to one another by any suitable means. In the representative embodiment shown in FIG. 10, the bottoms and opposing sides of the two pieces are stitched to one another.

In one aspect, the pocket 1022 is positioned next to the back surface of the hairpiece 1012. The pocket can be secured to the hairpiece 1012 by any suitable means. In the representative embodiment shown if FIGS. 10 and 11, the top of the back 1034 of the pocket is secured to the underside of finishing material 1033 using the stitching that secures the finishing material to the base.

In one aspect of the invention, the hairpiece 1022 includes a means by which the user can adjust the effective size of the pocket. In the representative embodiment shown in FIG. 10, the pocket includes a pair of adjustment straps 1036, having first and second ends 1038 and 1040, respectively, the first end of each adjustment strap attached to one of the opposing sides 1022 and 1024. In the representative embodiment illustrated in FIG. 10, the second end of each adjustment strap contains a hook 1042 and the bottom of the pouch contains a series of receiving slots 1044. By selecting the receiving slots in which the hooks are fastened, both the effective width and height can be adjusted by the user. In an alternative embodiment shown in FIG. 11, the length of a single adjustment string 1045 can adjusted using clasp 1046 so that the effective width of the open can be adjusted.

Shown in FIGS. 12 A-D is a method for placing the headwear 32 on the head 60 of a wearer who already has her own long hair 62, but, for example, for religious reasons, desires to hide her own hair. In a first step shown in FIG. 12A, the wearer ties her own hair in a bun 64 set so that the bun will be positioned above the opening 31 of the cap when the hat is worn. In a second step, shown in FIG. 12B, the bun is held with one hand while the cap is secured on top of wearer's head, such that the wearer's own hair does not trail out of the opening. And in those embodiments where the hairpiece contains a pocket, the bun inserted into the pocket. In a third step, shown in FIG. 12C, any stray hairs of the wearer's own hair are tucked up and away from the hole and into the area of the hat beneath the top of the opening. In an alternative embodiment, shown in FIG. 12D, a headband 66 is placed around the wearer's head before the cap is placed on the wearer's head.

Figure 13:
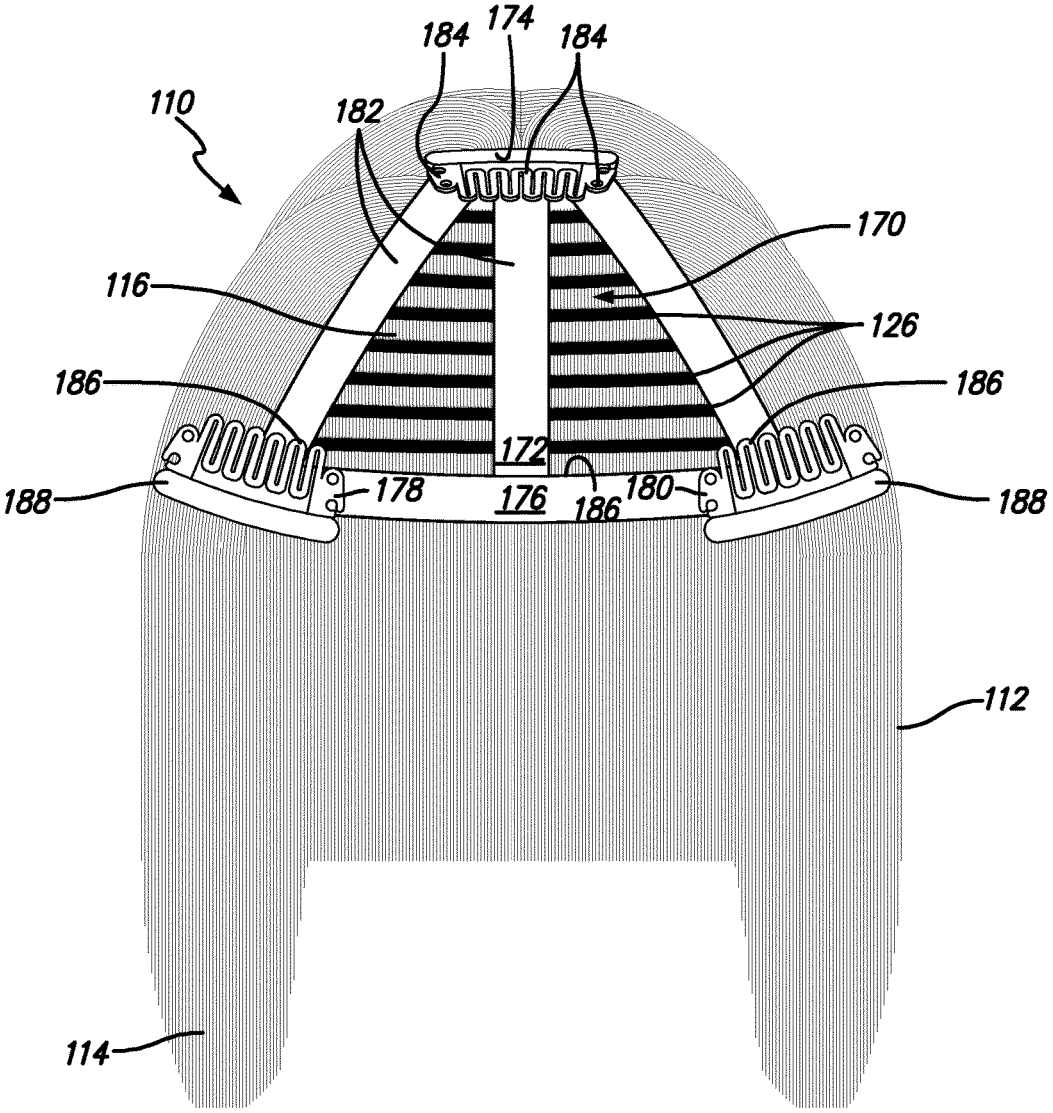
FIG. 13 is a back elevation view of a reattachable hairpiece in accordance with another aspect of the invention.

FIG. 13 is a back elevation view of another aspect of the reattachable headwear 110 in accordance with the invention. In some aspects, the attached end 116 of a plurality of hairs 112 is secured to a flexible shell 170 having an inner surface 172 and an outer surface 174. The shell is comprised of a perimeter portion 176, having first and second ends 178 and 180 respectively, and a plurality of rib portions 182, having first and second ends, 184 and 186, respectively. A flexible perimeter hairclip 188 is affixed to each of the first and second perimeter ends. The first end of each rib portion is attached to the perimeter portion. A crown is formed by attaching each of the second ends to a crown hairclip 190.

The attached end 116 of a plurality of hairs 112 is secured to the flexible shell 170 by any suitable attachment means. In some embodiments, extending longitudinally across at least one the surfaces of the shell is at least one strip of clothing binding 126 securing at least a portion of the plurality of hairs to the shell. In the representative embodiments shown in FIG. 7, eight clothing binding strips, evenly spaced on the outer surface 174 of the shell secure the plurality of hairs to the shell.

Figure 14:
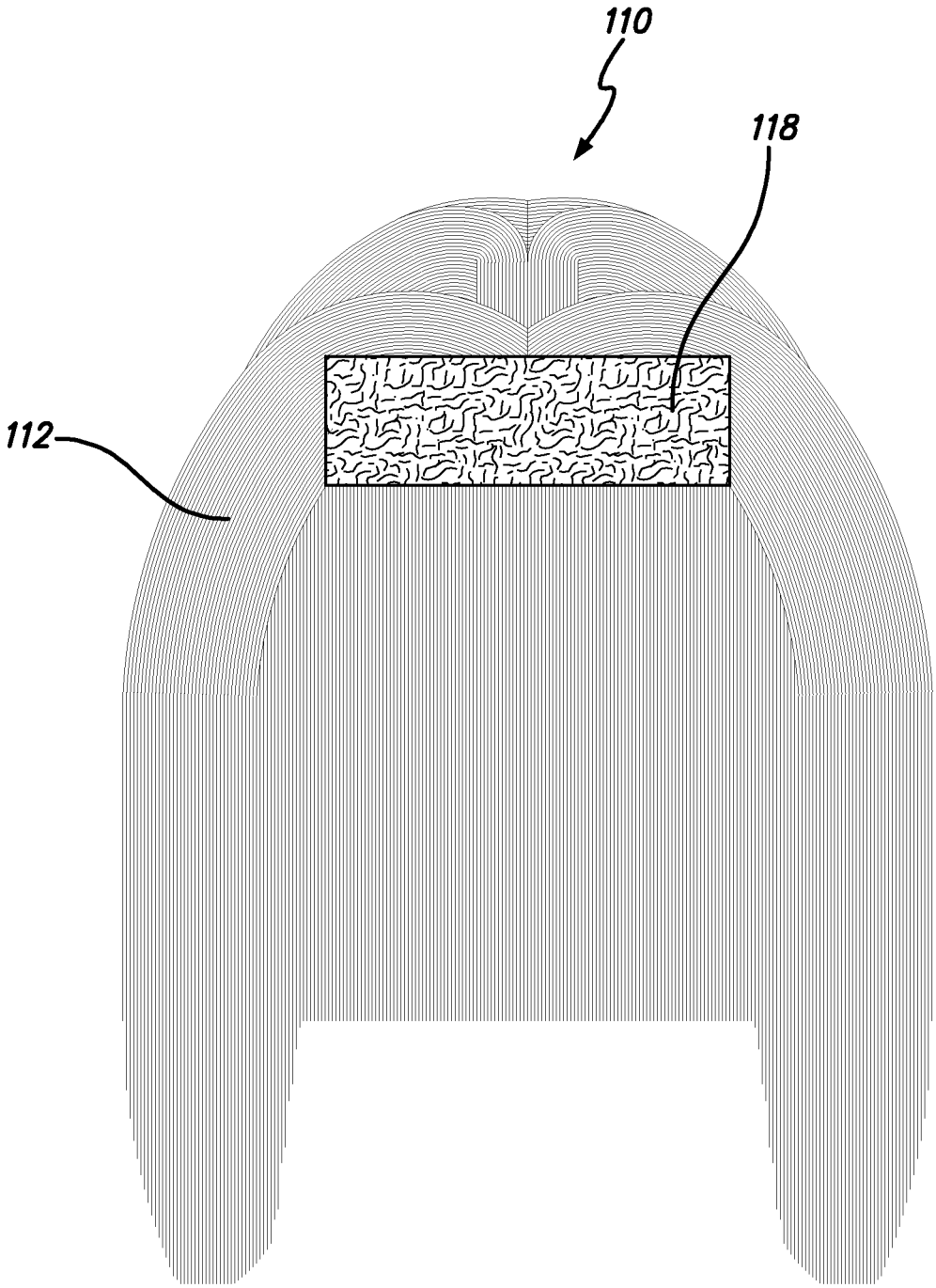
FIG. 14 is a front elevation view of the reattachable hairpiece of FIG. 13 in accordance with another aspect of the invention.

FIG. 14 is a front elevation view of the reattachable headwear 110. A hook and loop fastener strip 118 is attached to the front of the headwear. In some embodiments, the fastener has a generally rectangular shape. In some embodiments, the fastener has a width of from about 2½ inches to about 3½ inches and in some embodiments, the fastener has a width of from about 2¾ inch to about 3¼ inch. In some embodiments, the fastener has a height of from about 1½ inches to about 2½ inches and in some embodiments, the hat has a height of from about 1¾ inch to about 2¼ inch.

The hook and loop fastener 118 can be attached to the shell 170 by any suitable means. In the representative embodiment shown in FIG. 8, the hook and loop fastener is sewn to a portion of the plurality of hairs 112 and to the underlying shell (see FIG. 13).

Figure 15:
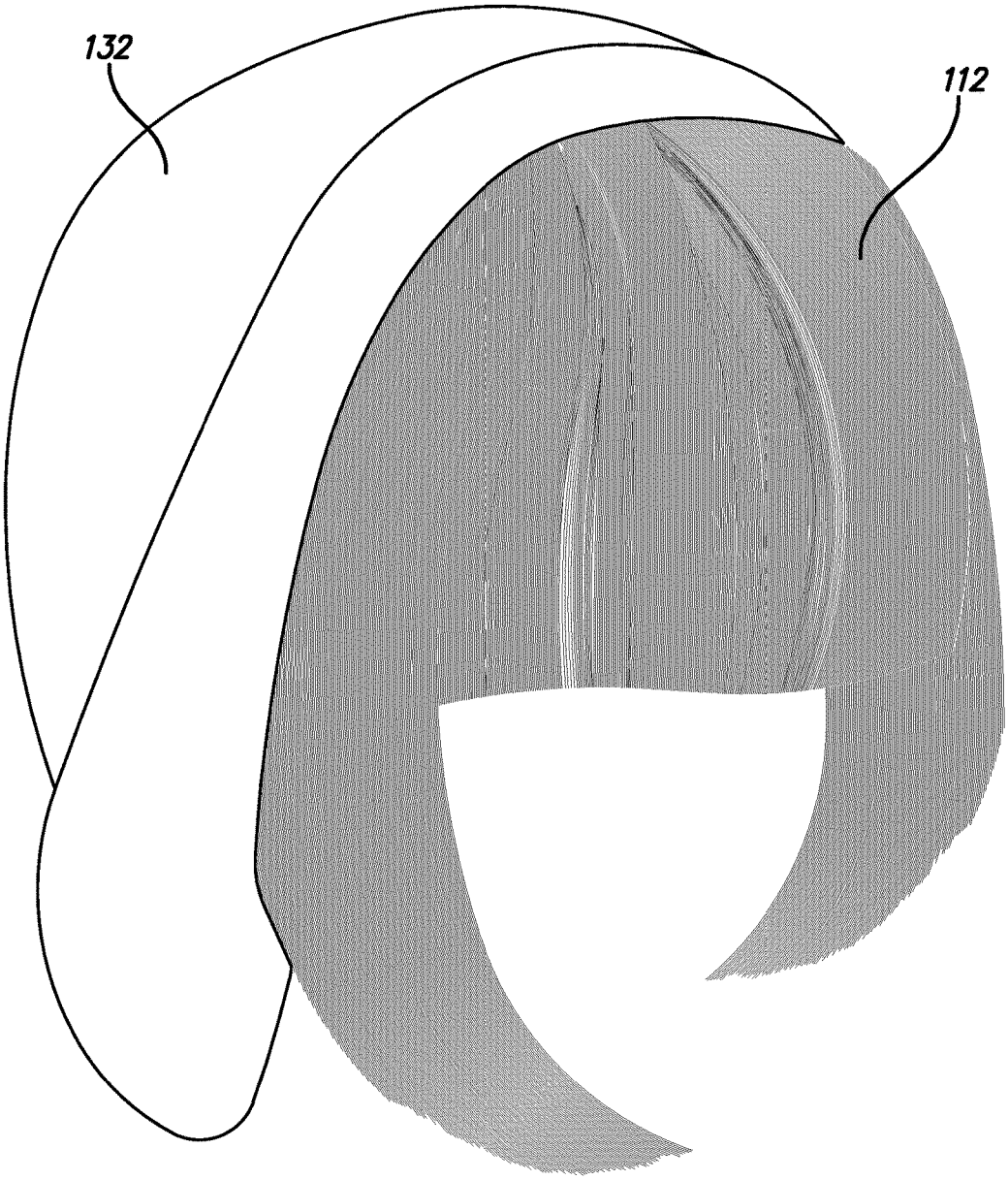
FIG. 15 is a perspective view of another embodiment of headwear with the reattachable hairpiece shown in FIGS. 13 and 14 in the attached position.

As shown in FIG. 15, in one embodiment the headwear 132 is a snood.

I claim:

1. A hairpiece comprising:

a plurality of hairs having a first end and a second end;

a binding for the plurality of hairs disposed at the first end of the plurality of hairs, wherein the binding comprises:

a body having a front surface, an opposing rear surface, and a perimeter, the front and rear surfaces comprising a top edge, a bottom edge, a first side edge and an opposing second side edge, wherein the top edge, bottom edge, first side edge, and opposing second side edge form the perimeter of the body; and a first ear flap and a second ear flap attached to the perimeter of the body, the first ear flap and the second ear flap extending axially from the first side edge and the opposing second side edge, respectively, wherein each ear flap has a top edge, a front surface and an opposing rear surface; and an attachment edge for attaching the hairpiece to a headwear, the attachment edge comprising the top edge of each ear flap and the top edge of the body; and at least one reattachable fastener coupled to the first end of the plurality of hairs, the at least one reattachable fastener operable to releasably engage with the headwear;

wherein each ear flap comprises a stay interposed between the front surface and the rear surface of each ear flap.

2. The hairpiece of claim 1, wherein the front surface of each ear flap is integral with the front surface of the body.

3. The hairpiece of claim 1, wherein the stays are comprised of a plastic or metallic material.

4. The hairpiece of claim 1, wherein each ear flap comprises a first pair of diagonally opposed corners, a second pair of diagonally opposed corners, a first stay extending between the first pair of diagonally opposed corners, and a second stay extending between the second pair of diagonally opposed corners.

5. The hairpiece of claim 1, wherein the at least one reattachable fastener is a flexible hook and loop fastener.

6. The hairpiece of claim 1, wherein the top edge is substantially straight.

7. The hairpiece of claim 6, wherein the top edge has a width of from about 10 inches to about 15 inches.

8. The hairpiece of claim 6, wherein the top edge has a width of from about 12 inches to about 17 inches.

9. The hairpiece of claim 1, wherein the at least one reattachable fastener has a width that is the substantially the same as the width of the top edge.

10. The hairpiece of claim 1, wherein the top edge, bottom edge, and opposing first side edge and second side edge of the body define a concave surface that conforms to a user's head when the hairpiece is releasably attached to the headwear.

11. The hairpiece of claim 1, wherein the attachment edge comprising the top edge of the each ear flap and the top edge of the body is finished with the same piece of material.

12. A hairpiece system comprising:

a headwear comprising:

an interior surface;

a first complementary fastener affixed to the interior surface; and a releasably attachable hairpiece comprising:

a plurality of hairs having a first end and a second end;

a binding for the plurality of hairs disposed at the first end of the plurality of hairs, wherein the binding comprises:

a body having a front surface, an opposing rear surface, and a perimeter, the front and rear surfaces comprising a top edge, a bottom edge, a first side edge and an opposing second side edge, wherein the top edge, bottom edge, first side edge, and opposing second side edge form the perimeter of the body; and a first ear flap and a second ear flap attached to the perimeter of the perimeter of the body, the first ear flap and the second ear flap extending axially from the first side edge and the second opposing second side edge, respectively, wherein each ear flap has a top edge, a front surface and an opposing rear surface, each ear flap comprising a stay interposed between the front surface and the rear surface of each ear flap; and an attachment edge for attaching the hairpiece to the headwear, the attachment edge comprising the top edge of each ear flap and the top edge of the body; and a second complementary fastener coupled to the first end of the plurality of hairs, the second complementary fastener operable to releasably attach the hairpiece to the interior surface of the headwear, wherein the second complementary fastener has a width substantially the same as the width of the attachment edge.

13. The hairpiece system according to claim 12, wherein the first and second complementary fasteners is a flexible hook and loop fastener.

14. The hairpiece system according to claim 12, wherein the top edge, bottom edge, and opposing first and second side edges of the body define a concave surface that conforms to a user's head when the hairpiece is releasably attached to the interior surface.

15. The hairpiece system of claim 12, wherein attachment edge comprising the top edge of the each ear flap and the top edge of the body is finished with the same piece of material.

16. The hairpiece system of claim 12, wherein each ear flap comprises a first pair of diagonally opposed corners, a second pair of diagonally opposed corners, a first stay extending between the first pair of diagonally opposed corners, and a second stay extending between the second pair of diagonally opposed corners.

17. The hairpiece system or claim 12, wherein the first ear flap and the second ear flap are substantially rectangular in shape.

18. The hairpiece system of claim 12, wherein the first ear flap and the second ear flap have a width of from about ¾ inch to about 1¾ inch and a height of from about 1 inch to about 3 inches.

* * * * *